US009958131B2

(12) United States Patent
Tai

(10) Patent No.: US 9,958,131 B2
(45) Date of Patent: May 1, 2018

(54) HEATING DEVICE FOR A VEHICLE LAMP

(71) Applicant: MIN SHIANG CORPORATION, Tainan (TW)

(72) Inventor: Shang-kuei Tai, Taipei (TW)

(73) Assignee: Min Hsiang Corporation, Tainan (TW)

( * ) Notice: Subject to any disclaimer, the term of this patent is extended or adjusted under 35 U.S.C. 154(b) by 107 days.

(21) Appl. No.: 14/975,868

(22) Filed: Dec. 21, 2015

(65) Prior Publication Data

US 2017/0175971 A1 Jun. 22, 2017

(51) Int. Cl.
*F21V 7/00* (2006.01)
*F21S 8/10* (2006.01)

(52) U.S. Cl.
CPC ..... *F21S 48/34* (2013.01); *F21S 48/1159* (2013.01); *F21S 48/1233* (2013.01); *F21S 48/137* (2013.01)

(58) Field of Classification Search
CPC .... F21S 48/34; F21S 48/1159; F21S 48/1233; F21S 48/234; F21S 48/1388
See application file for complete search history.

(56) References Cited

U.S. PATENT DOCUMENTS 3,026,401 A * 3/1962 Cheviron ..... B60S 1/54 219/203
7,914,162 B1 * 3/2011 Huang ..... B60L 1/14 219/220
8,899,803 B2 * 12/2014 Marley ..... F21S 48/115 362/516
2014/0355286 A1 * 12/2014 Arita ..... F21S 48/1323 362/516
2016/0273754 A1 * 9/2016 Gongola ..... B64F 1/20

* cited by examiner

*Primary Examiner* — Elmito Breval
*Assistant Examiner* — Naomi M Wolford

(57) ABSTRACT

A vehicle lamp includes a housing having a compartment with an opening. At least one lighting element is mounted in the compartment, defines at least one light output range, and is electrically connected to a circuit board. A transparent cover is disposed in front of the opening of the housing. A thermally conductive member is mounted to a rear face of the transparent cover and has a shape located corresponding to a periphery of the at least one light output range. A front surface of the thermally conductive member abuts the rear face of the transparent cover. A heating element electrically connected to a heating control device is mounted to a rear surface of the thermally conductive member and includes a heating wire having a diameter smaller than a width of the thermally conductive member. The heating wire is longer than the thermally conductive member.

2 Claims, 10 Drawing Sheets

A - A

HEATING DEVICE FOR A VEHICLE LAMP

BACKGROUND OF THE INVENTION

The present invention relates to a heating device for a vehicle lamp and, more particularly, to a heating device for heating a vehicle lamp without blocking the main light output of the vehicle lamp while providing an excellent heating effect.

A vehicle generally includes vehicle lamps, such as headlamps, tail lamps, turn signals, and fog lamps, for illumination and warning purposes. However, snow could accumulate in the vehicle lamps in a snow condition and could block the light output. In an approach to solve this problem, a heating device is mounted in currently available vehicle lamps.

U.S. Pat. No. 8,899,803 discloses a headlamp including a housing, a heat dissipating mechanism, a main circuit board, two light emitting diodes, a lens, a wire heating element, a circuit board for the wire heating element, and an encapsulating layer. Two reflectors are mounted in the housing for producing high-beam and low-beam outputs. The two light emitting didoes are mounted in locations associated with the two reflectors. The heat dissipation mechanism is coupled to the two light emitting diodes and is electrically connected to the main circuit board. The lens is mounted in front of the housing. The circuit board for the wire heating element is mounted on the lens. The encapsulating layer is disposed over the wire heating element. The wire heating element is disposed on a central portion of the inner surface of the lens and is electrically coupled to the circuit board for the wire heating element.

In a snow condition, the circuit board for the wire heating element makes the wire heating element generate heat, generating heat energy for directly heating the central portion of the lens, such that the snow on the central portion on the outer surface of the lens can melt and fall, thereby avoiding hindrance to the light output.

However, the wire heating element is mounted on the central portion of the inner surface of the lens which is in the output path of the light rays of the two light emitting diodes after reflection by the two reflectors, such that the output luminance is reduced. The heating effect is reduced if a thinner wire heating element is used for reducing the hindrance to the output luminance. Furthermore, the structure including the main circuit board and the circuit board for the wire heating element has complicated components. Furthermore, the circuit board for the wire heating element mounted on the lens occupies the light-transmittable area.

U.S. Patent Nos. 6,563,286; 7,410,257; 7,553,053; and 8,459,848 and U.S. Patent Publication Nos. US20060011598 and US20010181565 also disclose a heating wire directly mounted to a central surface of a lens and include the same disadvantage of hindrance to the light output.

BRIEF SUMMARY OF THE INVENTION

The primary objective of the present invention is to provide a heating device for heating a lens of a vehicle lamp without adversely affecting the main light output of the vehicle lamp.

Another objective of the present invention is to provide a heating device capable of absorbing shock and reducing circuit board elements.

A vehicle lamp according to the present invention includes a housing made of rigid material. The housing includes a compartment having a front end with an opening. At least one lighting element is mounted in the compartment of the housing. The at least one lighting element is adapted to emit light rays passing through the opening of the housing. The at least one lighting element is adapted to define at least one light output range corresponding to a location of the opening. A circuit board is mounted in the compartment or outside of the housing. The circuit board is electrically connected to the at least one lighting element. A transparent cover made of rigid material is disposed in front of the opening of the housing and includes a front face and a rear face. A thermally conductive member is mounted to the rear face of the transparent cover and has a shape located corresponding to a periphery of the at least one light output range. The thermally conductive member includes a front surface and a rear surface. The front surface of the thermally conductive member abuts the rear face of the transparent cover. A heating element is mounted to the rear surface of the thermally conductive member. The heating element is elongated and includes a heating wire having a diameter smaller than a width of the thermally conductive member. The heating wire has a length larger than a length of the thermally conductive member. A heating control device is electrically connected to the heating element and controls operation of the heating element.

The rear surface of the thermally conductive member can include a wavy groove extending in a length direction, and the heating element can be inserted into the wavy groove and becomes wavy.

The heating element can include a core and an encapsulating layer. The heating wire of the heating element continuously and helically extends around the core. The encapsulating layer is elongated and resistant to heat. The encapsulating layer is wound around the heating wire and abuts the rear surface of the thermally conductive member.

The vehicle lamp can further include a coupling frame made of rigid material and having front and rear sides. The thermally conductive member can be made of soft material. The rear side of the coupling frame is coupled to a peripheral wall delimiting the opening of the housing. The front side of the coupling frame includes a coupling groove having a front opening. The thermally conductive member is inserted into the coupling groove via the front opening. The front surface of the thermally conductive member is located outside of the coupling groove and abuts the rear surface of the transparent cover.

In an example, the heating wire of the element has two ends electrically connected to two electric wires and a heating control device, the heating control device is mounted on the circuit board, and the circuit board can be operated to control operation of the heating control device.

In another example, the heating wire of the element has two ends electrically connected to two electric wires, the heating control device includes a switch electrically connected to the circuit board and the two electric wires, and the switch can be operated to control operation of the heating element.

In a further example, the heating wire of the element has two ends electrically connected to two electric wires, and the heating control device includes a temperature sensor electrically connected to the two electric wires, the circuit board, and the heating element.

The thermally conductive member can include a coupling hole. The temperature sensor is mounted in the coupling hole and abuts the rear face of the transparent cover.

The vehicle lamp can further include two reflectors mounted in the compartment of the housing. The at least one lighting element includes two lighting elements respectively mounted in front of the two reflectors. The two lighting elements are adapted to emit light rays reflected by the two reflectors to pass forward through the transparent cover. The at least one light output range includes two light output ranges. The opening includes upper and lower sections corresponding to the two light output ranges. The two reflectors are separated by a separation portion. The coupling frame includes a peripheral portion corresponding to peripheral portions of the two light output ranges. The coupling frame further includes a central portion aligned with the separation portion and having two ends connected to the peripheral portion of the coupling frame. The coupling groove is defined in the peripheral portion and the central portion of the coupling frame. The thermally conductive member includes a peripheral section and a central section. The peripheral section and the central section of the thermally conductive member are engaged in the coupling groove of the coupling frame.

The present invention will become clearer in light of the following detailed description of illustrative embodiments of this invention described in connection with the drawings.

DETAILED DESCRIPTION OF THE INVENTION

Figure 1:
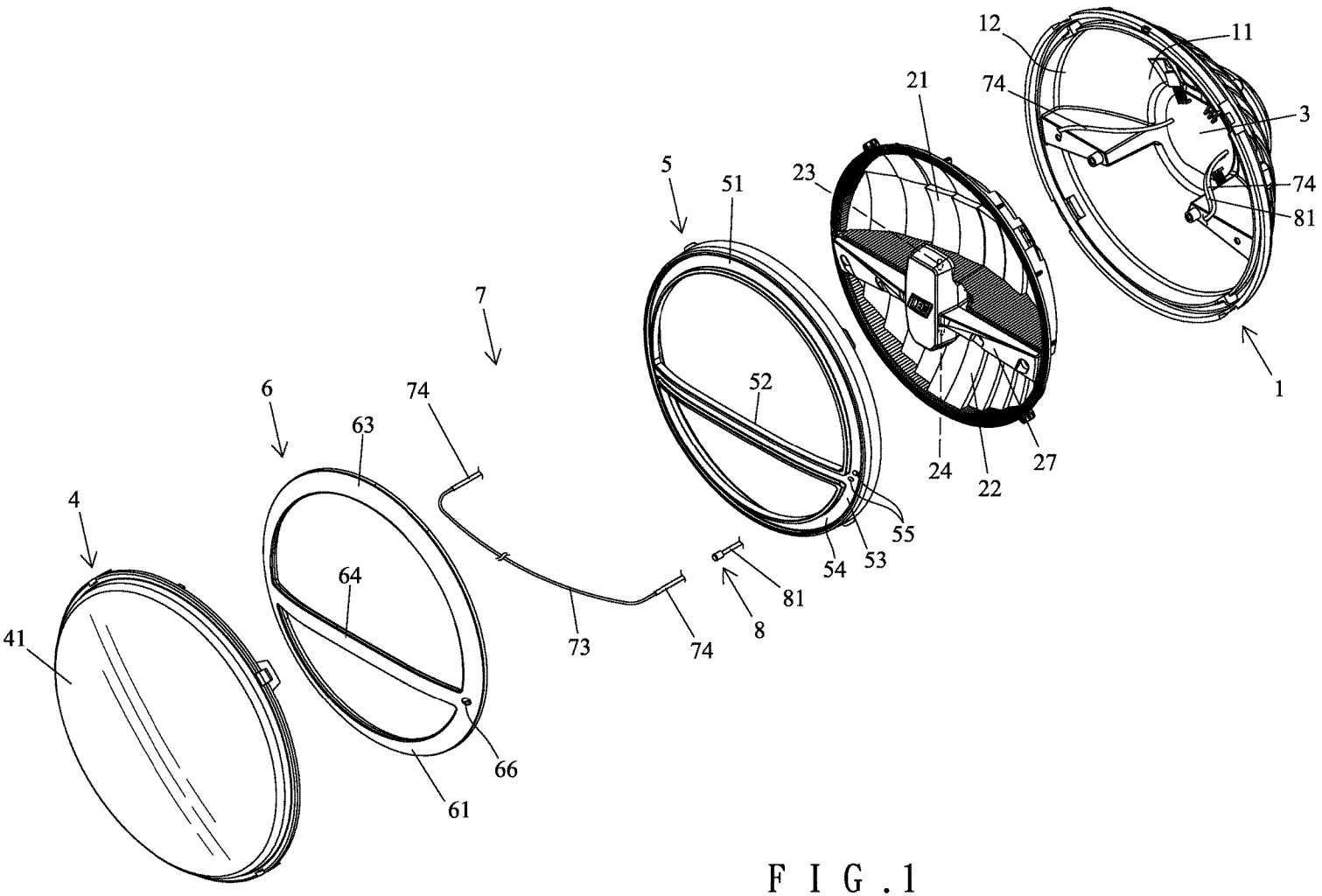
FIG. 1 is an exploded, perspective view of a vehicle lamp including a heating device of a first example according to the present invention.
Figure 2:
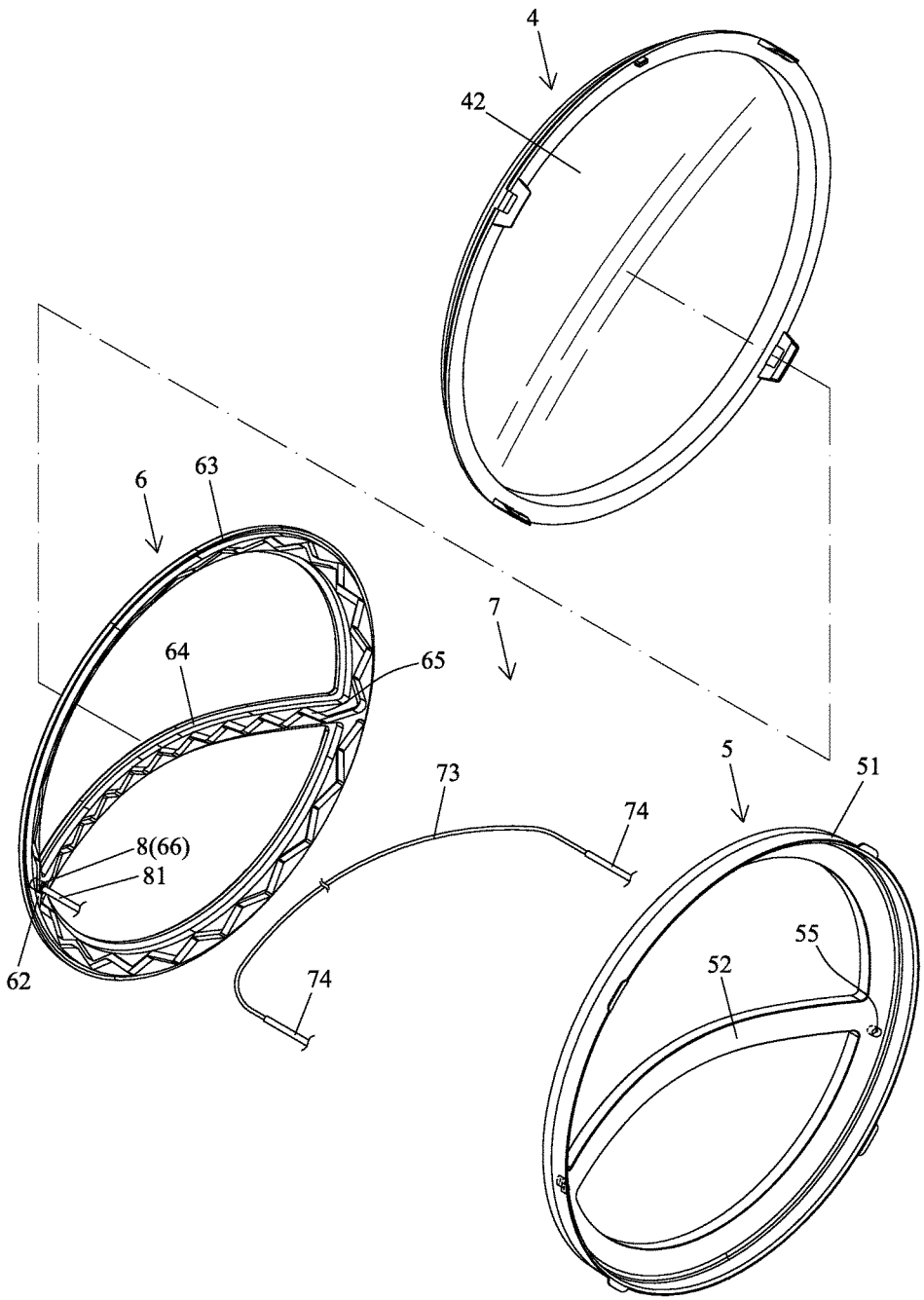
FIG. 2 is an exploded, perspective view of some elements of the vehicle lamp of FIG. 1.

It is noted that like reference numbers designate like elements in the examples of the present invention.

With reference to FIGS. 1-6, a vehicle lamp of a first example according to the present invention includes a housing 1, two reflectors 21 and 22, two lighting elements 23 and 24, a circuit board 3, a transparent cover 4, a coupling frame 5, a thermally conductive member 6, a heating element 7, and a temperature sensor 8.

The housing 1 is made of rigid material and includes a compartment 11 having a front end with an opening 12. The two reflectors 21 and 22 are mounted in the compartment 11 of the housing 1. The two lighting elements 23 and 24 can be light emitting diodes or other lighting elements. The two lighting elements 23 and 24 are mounted in the compartment 11 of the housing 1 and are respectively located in front of the two reflectors 21 and 22. The two lighting elements 23 and 24 are adapted to emit light rays reflected by the two reflectors 21 and 22 to pass forward through the transparent cover 4. The two lighting elements 23 and 24 are adapted to define two light output ranges 25 and 26 (see phantom lines in FIG. 6) corresponding to upper and lower sections of the opening 12. The two reflectors 23 and 24 are separated by a separation portion 27. In this example, the vehicle lamp is a headlamp, the light output range 25 is a low-beam pattern, and the light output range 26 is a high-beam pattern.

The circuit board 3 can be mounted in the compartment 11 or outside of the housing 1. The circuit board 3 is electrically connected to an external circuit (not shown) of a vehicle to control operation of the two lighting elements 23 and 24.

The transparent cover 4 is made of rigid material, is disposed in front of the opening 12 of the housing 1, and seals the opening 12. The transparent cover 4 includes a front face 41 and a rear face 42.

The coupling frame 5 is made of aluminum or other rigid material. A rear side of the coupling frame 5 is coupled to a peripheral wall delimiting the opening 12 of the housing 1. The coupling frame 5 includes a peripheral portion 51 corresponding to peripheral portions of the two light output ranges 25 and 26. The coupling frame 5 further includes a central portion 52 aligned with the separation portion 27 and having two ends connected to the peripheral portion 51 of the coupling frame 5, such that the coupling frame 5 will not block the main light rays passing through the two light output ranges 25 and 26. A front side of the coupling frame 5 incudes a coupling groove 53 defined in the peripheral portion 51 and the central portion 52. The coupling groove 53 has a front opening 54. Three through-holes 55 are defined in a bottom wall of the coupling groove 53.

The thermally conductive member 6 is made of thermally conductive rubber or other thermally conductive soft material. The thermally conductive member 6 can be elongated and has a shape corresponding to the coupling frame 5. The thermally conductive member 6 has a front surface 61 and a rear surface 62. The thermally conductive member 6 includes a peripheral section 63 corresponding to peripheries of the two light output ranges 25 and 26. The thermally conductive member 6 further includes a central section 64 having two ends connected to the peripheral section 63. The peripheral section 63 and the central section 64 are inserted through the front opening 54 to be engaged in the coupling groove 53 of the coupling frame 5. Thus, the thermally conductive member 6 is supported and positioned by the coupling frame 5. The front surface 61 of the thermally conductive member 6 is located in front of (and outside of) the coupling groove 53. The rear surface 62 of the thermally conductive member 6 includes a wavy groove 65 extending in a length direction and extending along the peripheral section 63 and the central section 64. A coupling hole 66 extends from the front surface 61 through the rear surface 62 of the thermally conductive member 6.

Figure 3:
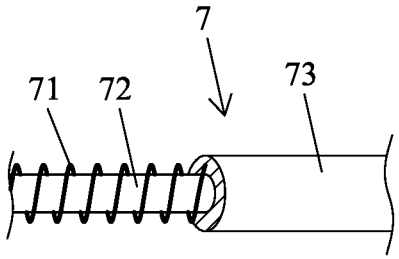
FIG. 3 is a partial perspective view of a heating element of the heating device of FIG. 1.
Figure 4:
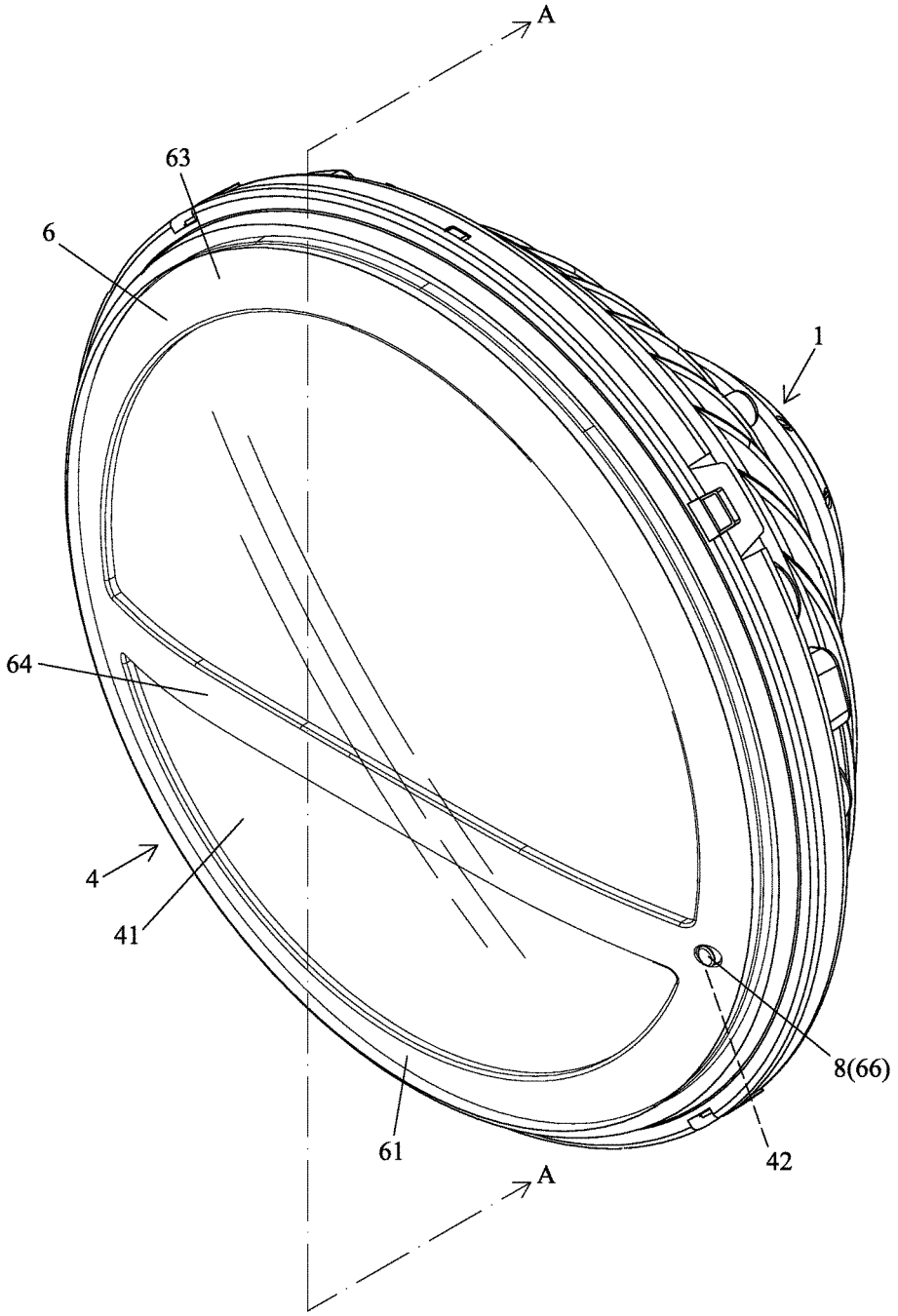
FIG. 4 is a perspective view of the vehicle lamp of FIG. 1 after assembly.
Figure 5:
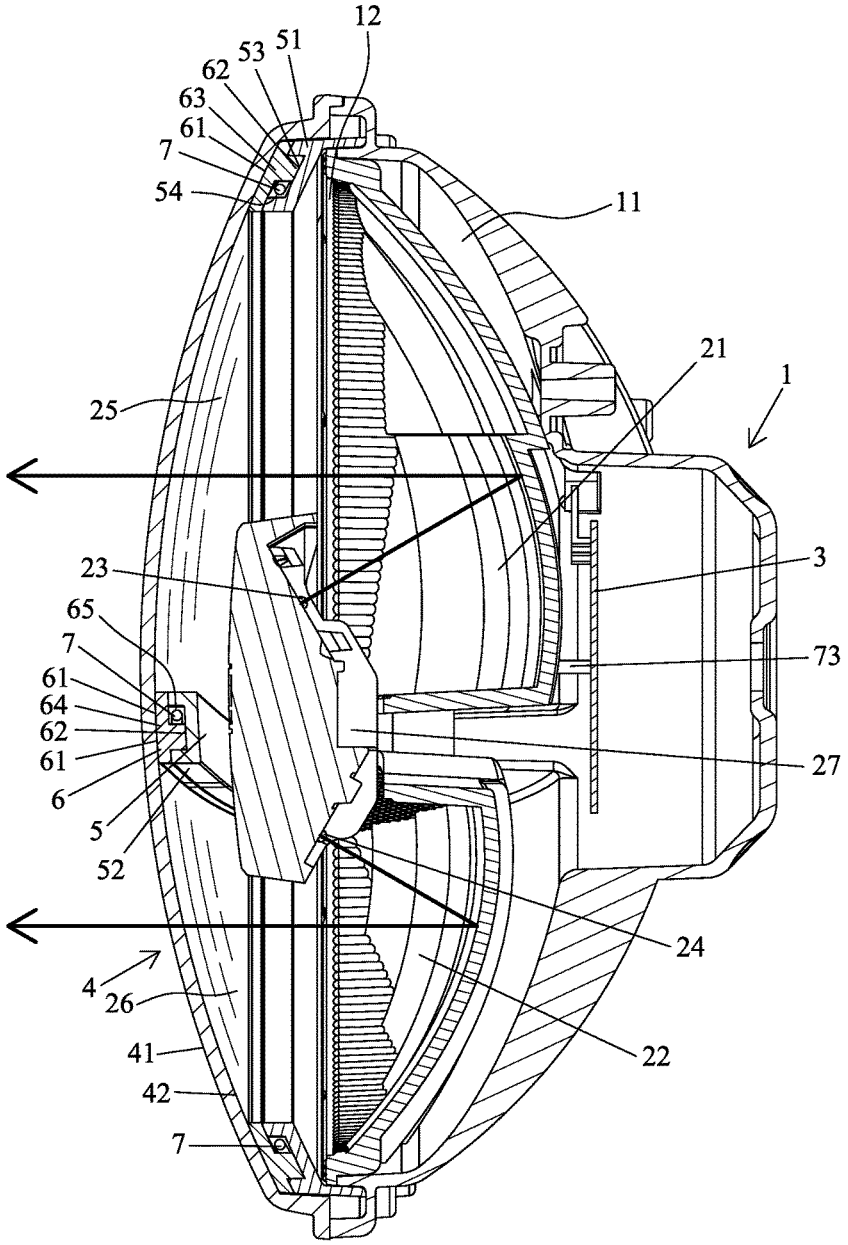
FIG. 5 is a cross sectional view taken along section line A-A of FIG. 4.
Figure 6:
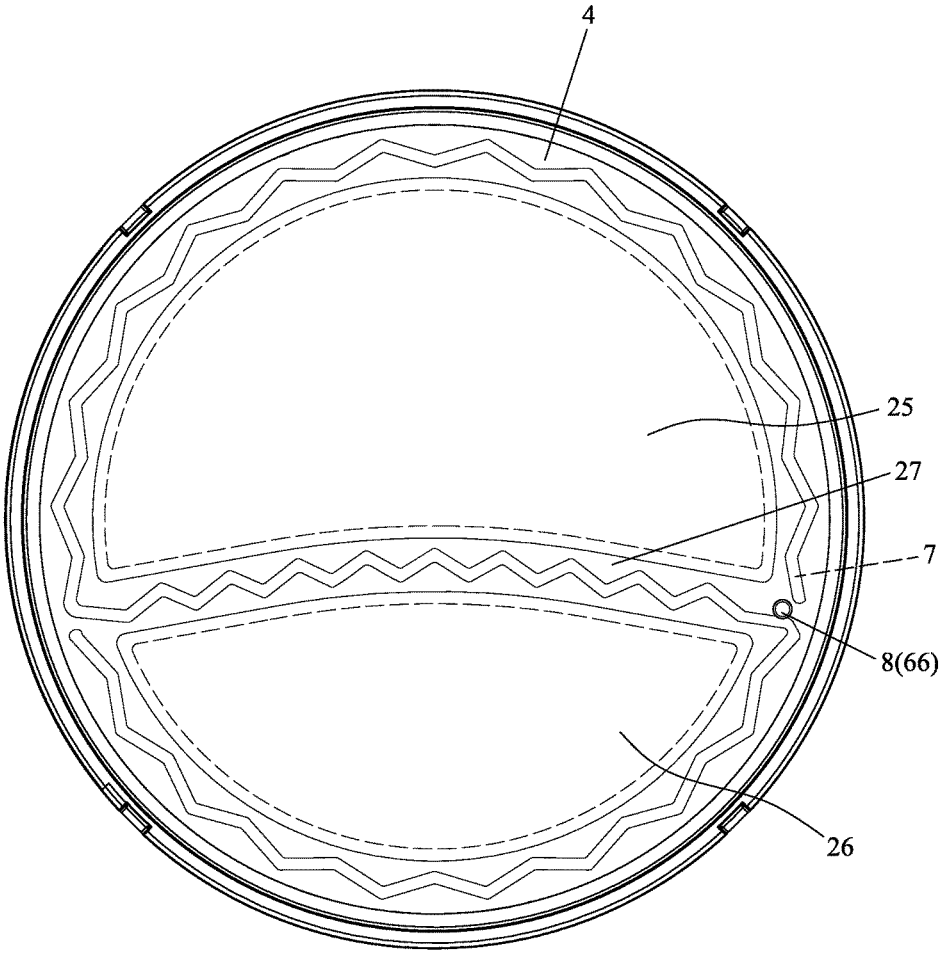
FIG. 6 is a front view of the vehicle lamp of FIG. 4.

The heating element 7 includes a heating wire 71. As shown in FIG. 3, the heating wire 71 continuously and helically extends around an elongated core 72, and an encapsulating layer 73 is wound around the heating wire 71, forming a heating element 7 with improved strength. The encapsulating layer 73 is elongated and resistant to heat. Two ends of the heating wire 71 of the element 7 are electrically connected to two electric wires 74 extending through two of the through-holes 55 of the coupling frame 5 and electrically connected to the circuit board 3. The heating element 7 is inserted into the wavy groove 65 of the thermally conductive member 6 and becomes wavy. The encapsulating layer 73 abuts the rear surface 62 of the thermally conductive member 6. The length of the encapsulating layer 73 can be larger than a length of the thermally conductive member 6 in the corresponding coupling location. The length of the helically extending heating wire 71 is larger than the length of the encapsulating layer 73 and the length of the thermally conductive layer 6 to increase the heating efficiency.

The temperature sensor 8 is mounted in the coupling hole 66 of the thermally conductive layer 6 and has a front end abutting the rear face 42 of the transparent cover 4. The temperature sensor 8 is electrically connected to the circuit board 3 by an electric wire 81 extending through one of the through-holes 55 of the coupling frame 5.

After the transparent cover 4 is coupled to the housing 1, the rear face 42 of the transparent cover 4 abuts the soft thermally conductive layer 6 that prevents direct contact between the transparent cover 4 and the rigid coupling frame 5, providing a buffering, shock-absorbing effect. The coupling frame 5 and the thermally conductive layer 6 are located corresponding to peripheries of the two light output ranges 25 and 26 without blocking the main light output, providing improved light output efficiency.

In a case that the ambient temperature is lower than a preset value, the temperature sensor 8 can detect the temperature and activates the circuit board 3 to make the heating wire 71 generate heat. The heating wire 7 is densely disposed on the rear surface 62 of the thermally conductive layer 6, such that the thermally conductive layer 6 can receive heat energy from the heating wire 7 having a length larger than the length of the thermally conductive layer 6. Furthermore, the thermally conductive layer 6 can rapidly heat the transparent cover 4. In this example, the central section 64 of the thermally conductive layer 6 is aligned with a central portion of the transparent cover 4, such that the central portion of the transparent cover 4 can be rapidly heated. If the thermally conductive layer 6 does not include the central section 64 aligned with the central portion of the transparent cover 4, the peripheral section 63 of the thermally conductive layer 6 can provide sufficient heat energy to the central portion of the transparent cover 4.

Even if the thermally conductive layer 6 blocks a peripheral portion of the two light output ranges 25 and 26, the central portion of the two light output ranges 25 and 26 will not be blocked to assure improved output efficiency better than the conventional structures. In practice, the design of the two reflectors 21 and 22 assures the thermally conductive layer 6 will not block the two light output ranges 25 and 26. Furthermore, a stronger heating wire 71 having a diameter larger than that shown in FIG. 3 can be directly and densely disposed in the wavy groove 65 of the thermally conductive layer 6. The heating wire 71 does not have to be helical. The heating element 7 does not have to include the encapsulating layer 73 around the heating wire 71 while providing the heating efficiency.

The electric wires 74 of the heating element 7 and the electric wire 81 of the temperature sensor 8 can be connected to a control circuit board (not shown) mounted behind the transparent cover 4 and electrically connected to the circuit board 3. Furthermore, the heating control device can be directly mounted on the circuit board 3. When the circuit board 3 is supplied with electricity, the heating element 7 is activated to generate heat.

The heating control device can include a switch electrically connected to the circuit board 3 and the two electric wires 74. The switch can be located outside of the vehicle lamp and can be operated to control operation of the heating element 7.

Figure 7:
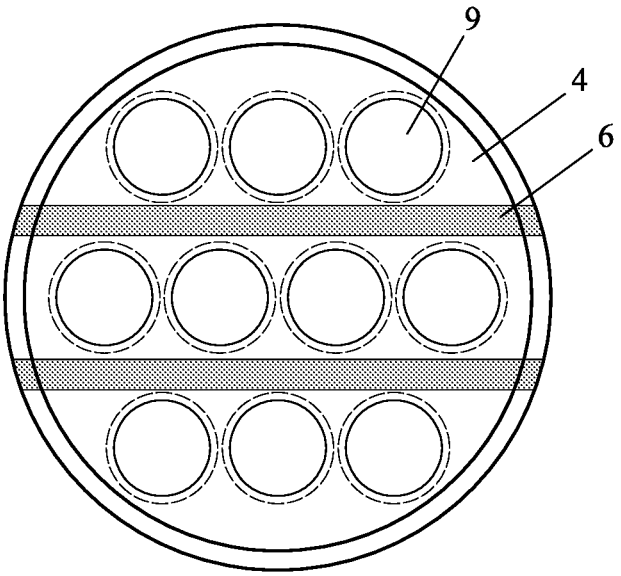
FIG. 7 is a front view of a second example according to the present invention.

The thermally conductive layer 6 according to the present invention can have different dispositions according to the light output ranges of the vehicle lamp that could be a tail lamp, a brake lamp, a fog lamp, or other lamps other than a headlamp. The lighting elements according to the present invention can be reflected by the reflectors 21 and 22 or directly transmit through a lens. FIG. 7 shows a second example similar to the first example except that the headlamp includes a plurality of rows of lenses 9. A lighting element (not shown) is mounted behind each lens 9 and can emit light rays directly transmit through the associated lens 9. The light output range of each lens 9 is shown by phantom lines. The thermally conductive layer 6 is located between the light output ranges to heat the central portion of the transparent cover 4. The thermally conductive layer 6 does not have to include the peripheral section 63.

Figure 8:
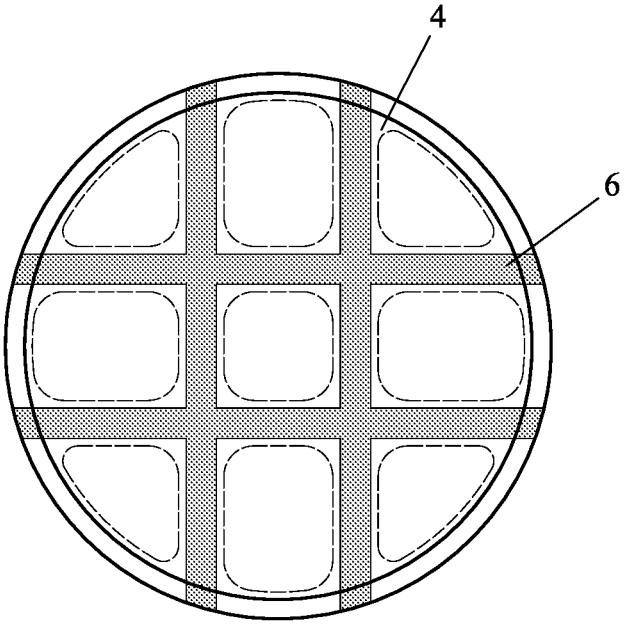
FIG. 8 is a front view of a third example according to the present invention.
Figure 9:
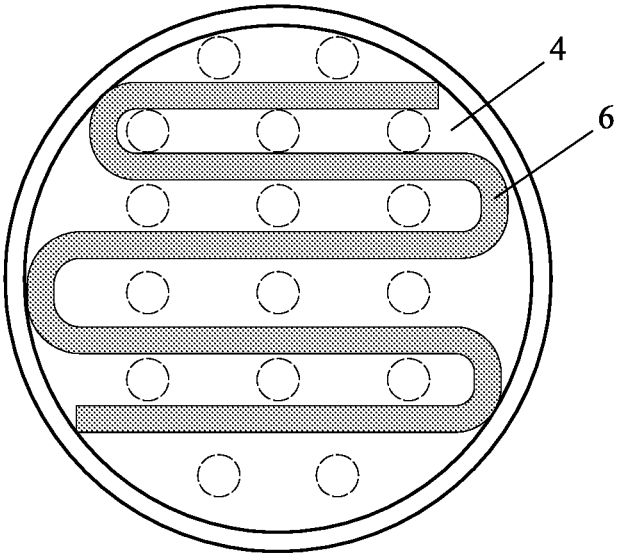
FIG. 9 is a front view of a fourth example according to the present invention.
Figure 10:
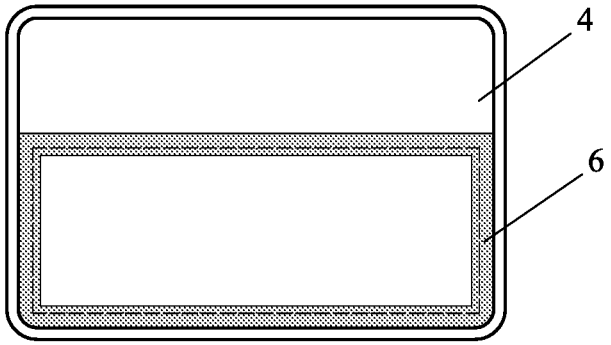
FIG. 10 is a front view of a fifth example according to the present invention.

FIGS. 8-10 show third, fourth, and fifth examples according to the present invention, respectively. The heating structure is substantially the same as the first example. The light output ranges are shown by the phantom lines. A lighting element (not shown) and a reflector (not shown) are disposed for each light output range. The thermally conductive layer 6 can have different dispositions according to the arrangement of the light output ranges.

Although specific embodiments have been illustrated and described, numerous modifications and variations are still possible without departing from the scope of the invention. The scope of the invention is limited by the accompanying claims.

The invention claimed is:

1. A vehicle lamp comprising:

a housing, made of rigid material including a compartment having a front end with an opening;

at least one lighting element mounted on non-parallel, different planes and sitting in front of two reflectors in the compartment of the housing, with the at least one lighting element adapted to emit light rays passing through the opening of the housing, and with the at least one lighting element adapted to define at least one light output range corresponding to a location of the opening;

a circuit board mounted in the compartment or outside of the housing, with the circuit board electrically connected to the at least one lighting element;

a transparent cover made of rigid material, with the transparent cover mounted in front of the opening of the housing, and with the transparent cover including a front face and a rear face;

a thermally conductive member mounted to the rear face of the transparent cover and having a shape located corresponding to a periphery of the at least one light output range, with the thermally conductive member including a front surface and a rear surface, and with the front surface of the thermally conductive member abutting the rear face of the transparent cover;

a heating element of a bendable string mounted to the rear surface of the thermally conductive member, with the heating element being elongated and including a heating wire having a diameter smaller than a width of the thermally conductive member, and with the heating wire having a length larger than a length of the thermally conductive member;

a heating control device electrically connected to the heating element and controlling operation of the heating element, further comprising a coupling frame made of rigid material, with the thermally conductive member made of soft material, with the coupling frame including a front side and a rear side, with the rear side of the coupling frame coupled to a peripheral wall delimiting the opening of the housing, with the front side of the coupling frame including a coupling groove having a front opening, with the thermally conductive member inserted into the coupling groove via the front opening, with the front surface of the thermally conductive member located outside of the coupling groove and abutting the rear surface of the transparent cover.

2. The vehicle lamp as claimed in claim 1, wherein the two lighting elements are adapted to emit light rays reflected by the two reflectors to pass forward through the transparent cover, with the at least one light output range including two light output ranges, with the opening including upper and lower sections corresponding to the two light output ranges, with the two reflectors separated by a separation portion, with the coupling frame including a peripheral portion corresponding to peripheral portions of the two light output ranges, with the coupling frame further including a central portion aligned with the separation portion and having two ends connected to the peripheral portion of the coupling frame, with the coupling groove defined in the peripheral portion and the central portion of the coupling frame, with the thermally conductive member including a peripheral section and a central section, and with the peripheral section and the central section of the thermally conductive member engaged in the coupling groove of the coupling frame.

* * * * *